US006262401B1

(12) United States Patent
Knoeppel et al.

(10) Patent No.: US 6,262,401 B1
(45) Date of Patent: Jul. 17, 2001

(54) GOLD-PLATED WATER HEATER ELEMENT AND METHOD OF MAKING SAME

(75) Inventors: Ray O. Knoeppel, Hartland; Dennis R. Hughes, Hartford, both of WI (US)

(73) Assignee: AOS Holding Company, Wilmington, DE (US)

( * ) Notice: Subject to any disclaimer, the term of this patent is extended or adjusted under 35 U.S.C. 154(b) by 0 days.

(21) Appl. No.: 09/469,645

(22) Filed: Dec. 22, 1999

Related U.S. Application Data

(60) Provisional application No. 60/144,135, filed on Dec. 30, 1998.

(51) Int. Cl.[7] ..... H05B 3/16

(52) U.S. Cl. ..... 219/543; 392/457; 392/489; 392/503; 219/481; 219/523

(58) Field of Search ..... 219/481, 523, 219/543, 548, 553; 392/441, 449, 451, 452, 453, 454, 455, 456, 457, 478, 485, 488, 489, 497, 503; 204/196.37; 428/408

(56) References Cited

U.S. PATENT DOCUMENTS

| | | | | |
|---|---|---|---|---|
| 3,664,868 | | 5/1972 | Davis et al. | 117/212 |
| 3,774,077 | | 11/1973 | Raffaelli et al. | 317/98 |
| 4,036,716 | * | 7/1977 | Hulthe | 204/196.37 |
| 4,057,707 | | 11/1977 | Allen | 219/543 |
| 4,073,970 | | 2/1978 | Allen | 427/96 |
| 4,168,214 | | 9/1979 | Fletcher et al. | 204/43 |
| 4,203,025 | * | 5/1980 | Nakatani et al. | 219/543 |
| 4,207,149 | | 6/1980 | Mason et al. | 204/46 |
| 4,238,300 | | 12/1980 | Yoshida | 204/46 |
| 4,510,377 | * | 4/1985 | Merritt et al. | 219/523 |
| 4,700,053 | * | 10/1987 | Driggers et al. | 219/523 |
| 4,724,182 | * | 2/1988 | Kato et al. | 219/543 |
| 4,736,092 | * | 4/1988 | Pirl et al. | 219/523 |
| 4,848,616 | | 7/1989 | Nozaki | 219/322 |
| 4,982,068 | * | 1/1991 | Pollock et al. | 392/488 |
| 5,054,108 | | 10/1991 | Gustin et al. | 392/492 |
| 5,072,236 | * | 12/1991 | Tatsumi et al. | 219/543 |
| 5,409,668 | * | 4/1995 | Bagley et al. | 219/543 |
| 5,557,704 | * | 9/1996 | Dennis et al. | 219/543 |
| 5,589,280 | | 12/1996 | Gibbons et al. | 428/626 |
| 5,643,483 | * | 7/1997 | Kubota et al. | 219/543 |

FOREIGN PATENT DOCUMENTS 98400857 4/1998 (FR) .

OTHER PUBLICATIONS

*Appliance*, Article Regarding Confortechnologies(1 page).
"Surface Cleaning, Finishing, and Coating", *Metals Handbook Ninth Edition*, vol. 5, pp. 199–206 (1982).

* cited by examiner

*Primary Examiner*—Teresa Walberg
*Assistant Examiner*—Fadi H. Dahbour
(74) *Attorney, Agent, or Firm*—Michael Best & Friedrich LLP

(57) ABSTRACT

A self-cleaning water heater element is provided. The water heater element is plated with a layer of gold such that the gold surface has a low surface roughness. The smooth gold surface inhibits scale formation on the water heater element. The gold-plated smooth-surfaced water heater element may be manufactured by coating a standard water heater element with an adhesion layer, electroplating a layer of bright nickel on the adhesion layer, and electroplating a gold layer on top of the bright nickel layer.

12 Claims, 1 Drawing Sheet

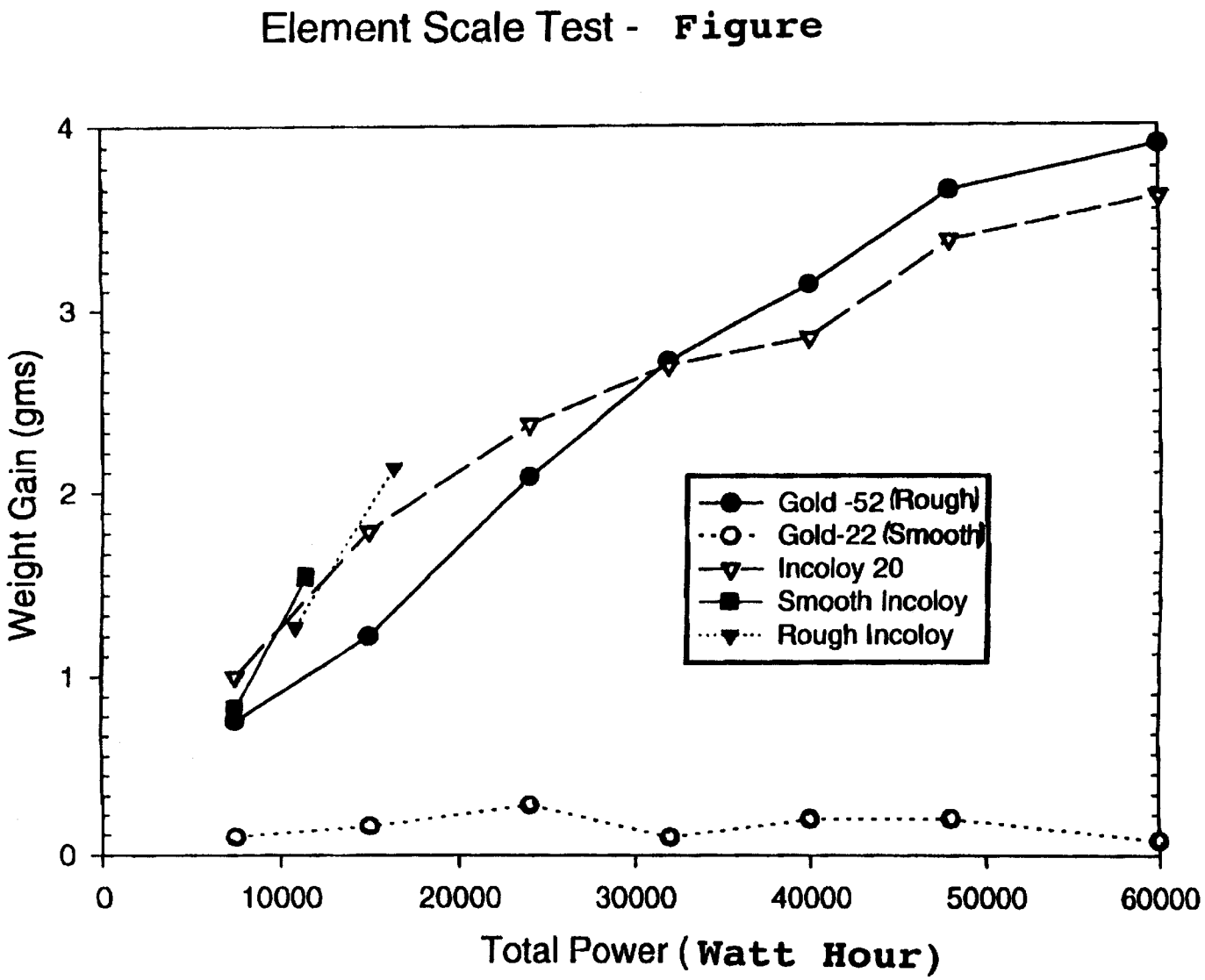
Element Scale Test - Figure
Weight Gain (gms)
0
1
2
3
4
Total Power (Watt Hour)
0
10000
20000
30000
40000
50000
60000
Gold -52 (Rough)
Gold-22 (Smooth)
Incoloy 20
Smooth Incoloy
Rough Incoloy

GOLD-PLATED WATER HEATER ELEMENT AND METHOD OF MAKING SAME

This application claims benefit of Provisional No. 60/114,135 filed Dec. 30, 1998.

BACKGROUND OF THE INVENTION

The present invention relates to heating elements utilized within water heaters.

Over time, electric water heater elements tend to develop scale (calcium carbonate). This scale is a poor heat conductor. The high heat flux at the heating element combined with the poor thermal conductivity of the scale film tends to cause the heating element to overheat, which can lead to failure. Also, the growth of scale on the element may physically deform the element and cause failure. Finally, as scale grows thick it tends to flake off the element and into the heated water.

A water heater element which minimizes or prevents scale growth or formation would be desirable.

SUMMARY OF THE INVENTION

The present invention provides a self-cleaning water heater element. The water heater element is plated with a noble metal, such as gold, having low surface roughness. It has been found that plating a water heater element with gold having a low surface roughness dramatically effects the ability of the water heater element to inhibit scale formation. If the gold surface is too rough, the heating element will not adequately inhibit scale formation. However, if the gold surface is sufficiently smooth, scale formation is inhibited.

The existence of a gold-plated heating element has been documented, for example in an article indicating that Tefal has incorporated a gold-plated heating element into cordless kettles as a means of reducing scale. Generally, kettles have much smaller heating elements than water heaters. Also, kettles typically are not utilized as frequently as water heaters and are not exposed to continuous water contact. Further, kettles run on lower wattage than water heaters, and water heaters are capable of heating a much larger volume of water (that is, gallons rather than cups).

One embodiment of the present invention is a self-cleaning water heater element comprising a water heater element, and a layer of gold at least partially coating the water heater element.

The invention also provides a process for the preparation of a self-cleaning water heater element. The process comprises providing a water heater element, and electroplating a layer of gold onto the water heater element.

Other features and advantages of the invention will become apparent to those skilled in the art upon review of the following detailed description, claims and drawing.

BRIEF DESCRIPTION OF THE DRAWING

The FIGURE shows a graph of weight gain (in grams of scale) versus total power (in watt hours) for water heater elements having various surface characteristics.

Before one embodiment of the invention is explained in detail, it is to be understood that the invention is not limited in its application to the details of construction, or to the steps or acts set forth in the following description. The invention is capable of other embodiments and of being practiced or being carried out in various ways. Also, it is understood that the phraseology and terminology used herein is for the purpose of description and should not be regarded as limiting.

DETAILED DESCRIPTION OF THE INVENTION

In a preferred embodiment, the present invention is a self-cleaning water heater element which comprises a water heater element having a cross-sectional diameter of at least about ⅛ inch; a strike layer of nickel chloride disposed on the water heater element; a layer of bright nickel having a thickness of at least about 200 microinches disposed on the nickel chloride layer; and a gold layer having a thickness of at least about 10 microinches disposed on the layer of bright nickel. Applying a gold layer to a water heater element provides a method of inhibiting scale formation on the water heater element. Preferably, the gold layer has a surface roughness less than about 30 microinches Ra. Ra is the arithmetic mean of the departure of the roughness profile from the mean line.

The water heater element of the invention may be manufactured like a customary water heater element, except a layer of gold is electroplated on the surface. The gold layer is preferably hard 24 karat gold plate which may be electroplated using customary electroplating techniques. Gold electroplating baths and processes are well-known, for example, as described in U.S. Pat. Nos. 4,168,214, 4,207,149 and 4,238,300, which are herein fully incorporated by reference. Preferably, the resulting gold layer is at least about 0.00001 inches (10 microinches) thick. To inhibit scale formation, the surface roughness of the gold layer is preferably less than about 30 microinches Ra; more preferably, less than about 20 microinches Ra; most preferably, less than about 15 microinches Ra. The roughness of the surface may be measured using a surface roughness tester such as a PROFILOMETER® (Trademark of the Warner & Swasey Company).

The smoothness of the gold surface layer may be controlled by applying an adhesion layer to the water heater element before electroplating gold on top. The adhesion layer preferably contains a "strike" layer of nickel chloride followed by a layer of bright nickel finish. The nickel chloride may be applied using a Woods Nickel electroplating bath. The bright nickel plate may be applied using a Watts bath. Nickel plating and plating baths are well-known. See, for example, pages 199–206 of the Metals Handbook Ninth Edition, Volume 5, Surface Cleaning, Finishing, and Coating (1982), which is herein fully incorporated by reference. The bright nickel layer is preferably about 0.0002 to 0.0004 inches (200 to 400 microinches) thick. Bright nickel finish contains known additives which result in a smooth finish.

Prior to electroplating, the water heater element may be lightly blasted (for example with glass beads) in order to remove oxides and scale which could inhibit adhesion of the electroplated layers to the element.

Standard water heater elements have a cross-sectional diameter of approximately ¼ to ½ inches. Preferably, the cross-sectional diameter of the water heater element is at least about ⅛ or ¼ inches.

In practice, the element is disposed in a water heater. Typically, water heaters have an anode attached thereto which helps to decrease corrosion of the water heater tank. Isolating the heating element from the anode may decrease scale formation on the element. The element may be suitably isolated, for example, through the use of a resistor as described in U.S. Pat. No. 4,848,616 to Nozaki which is herein fully incorporated by reference.

EXAMPLE 1

The FIGURE shows data from element scale tests in which the quantity of scale formed on various water heater elements is measured as a function of total power. The tests were carried out by inserting each element individually into a 20 gallon open top water heater filled with a saturated calcium carbonate solution, running the water heater, and periodically measuring the total power expended and the weight of the element. Five water heater elements were tested, each having different surface characteristics. Gold-52 and Gold-22 represent gold-plated water heater elements in which the surface roughness is 52 microinches Ra (rough gold) and 22 microinches Ra (smooth gold), respectively. Water heater elements are customarily made of incoloy. On the FIGURE, Incoloy 20, Smooth Incoloy, and Rough Incoloy represent incoloy elements having surface roughnesses of 20, 13, and 40 microinches Ra, respectively. Data for the incoloy elements are shown for purposes of comparison.

The FIGURE shows that a standard incoloy water heater element (which contains approximately 50% nickel) has approximately the same scale formation in weight gain whether the incoloy surface is rough (40 microinches Ra surface roughness) or smooth (13 microinches Ra surface roughness). In contrast, a gold-plated element has approximately the same weight gain as the incoloy elements when the surface is rough (shown as Gold-52 with a surface roughness of 52 microinches Ra). However, the scale formation in weight gain is dramatically reduced when the gold surface is smooth (shown as Gold-22 with a surface roughness of 22 microinches Ra).

The Gold-22 gold-plated water heater element is prepared as follows. A 0.375 inch diameter tubular element made of incoloy is coated with an adhesion layer of nickel chloride using a Woods nickel electroplating bath. A bright nickel layer having a thickness of 0.0002 to 0.0004 inches is electroplated on the nickel chloride layer using a bright Watts nickel electroplating bath. Finally, a layer of hard 24 karat gold having a minimum thickness of 0.00001 inches is electroplated onto the bright nickel layer.

EXAMPLE 2

Additional Testing was run to evaluate the effect of an anode on the scale performance of a gold plated element. The testing was run in a 20-gallon open top water heater filled with saturated calcium carbonate solution. Gold plated electric elements with 4.5 Kilowatt (KW) rating were run both with and without connection to an anode in the tank. Both elements were smooth surface elements (21 microinches Ra). The elements were left in the tanks until the elements had operated from 11 to 17 hours. Afterwards the elements were removed, dried and weighed. Results show that isolation of the gold element improves anti-scale performance. This is thought to be due to limiting scale formed as a result of cathodic protection.

| Element | Anode Protection | Energy Use (Kilo Watt-Hrs) | Wt. Gain(gms) | Wt. Gain vs. Energy use (mg/Kw) |
|---|---|---|---|---|
| Smooth Gold | Yes | 77 | 1.6 | 21 |
| Smooth Gold | No | 51 | 0.02 | 0.4 |

What is claimed is:

1. A water heater comprising:

a self-cleaning water heater heating element submersed in water in said water heater;

a gold layer at least partially coating the water heater heating element; and an adhesion layer disposed between the heating element and the gold layer.

2. The water heater of claim 1, wherein the gold layer has a surface roughness less than about 30 microinches Ra.

3. The water heater of claim 1, wherein the adhesion layer comprises a layer of nickel.

4. The water heater claim 1, further comprising a layer of bright nickel disposed between the heating element and the gold layer.

5. The water heater of claim 1, wherein the heating element has a diameter of at least about ⅛ inch.

6. The water heater of claim 1, wherein the self-cleaning heating element has an anode attached thereto, and wherein the heating element is electrically isolated from the anode.

7. A process for the preparation of a self-cleaning water heater heating element, the process comprising:

providing a water heater heating element;

applying an adhesion layer to the water heater heating element;

after said act of applying an adhesion layer, electroplating a layer of gold onto the adhesion layer of the water heater heating element;

providing a water heater for heating and storing a quantity of water; and submersing the heating element in the water in the water heater.

8. The process of claim 7, further comprising applying a layer of bright nickel to the adhesion layer of the water heater heating element before electroplating the gold layer.

9. A self-cleaning water heater heating element comprising:

a water heater heating element having a cross-sectional diameter of at least about ⅛ inch;

a strike layer of nickel chloride disposed on the water heater heating element;

a layer of bright nickel having a thickness of at least about 200 microinches disposed on the nickel chloride layer; and a gold layer having a thickness of at least about 10 microinches disposed on the layer of bright nickel, the gold layer having a surface roughness less than about 30 microinches Ra.

10. A method of inhibiting scale formation on a water heater heating element, the method comprising applying a gold layer to the heating element, the gold layer having a surface roughness less than about 30 microinches Ra.

11. The method of claim 10, further comprising providing a water heater having an anode attached thereto, the heating element being disposed in water stored in the water heater, the heating element being electrically isolated from the anode.

12. The method of claim 11, wherein the heating element is isolated from the anode with a resistor.

* * * * *